United States Patent [19]

Nilssen

[11] Patent Number: 5,047,696

[45] **Date of Patent: * Sep. 10, 1991**

[54] POWER-LIMITED CEILING LIGHTING SYSTEM

[76] Inventor: Ole K. Nilssen, Caesar Dr., Rte. 5, Barrington, Ill. 60010

[ * ] Notice: The portion of the term of this patent subsequent to May 19, 2004 has been disclaimed.

[21] Appl. No.: 425,436

[22] Filed: Oct. 23, 1989

Related U.S. Application Data

[63] Continuation of Ser. No. 703,027, Feb. 19, 1985, abandoned, which is a continuation-in-part of Ser. No. 450,187, Dec. 16, 1982, abandoned.

[51] Int. Cl.[5] ..... H05B 37/00; H05B 41/00

[52] U.S. Cl. ..... 315/312; 315/210; 315/324; 315/256; 361/377; 362/148

[58] Field of Search ..... 315/312, 324, 356, 209 R, 315/258, DIG. 5, 210, 224, 119, 97

[56] References Cited

U.S. PATENT DOCUMENTS

| | | | |
|---|---|---|---|
| 2,965,804 | 12/1960 | Roesel et al. | 315/201 |
| 4,158,793 | 6/1979 | Lewis | 315/101 |
| 4,207,498 | 6/1980 | Spira | 315/97 |
| 4,293,799 | 10/1981 | Roberts | 315/256 |
| 4,504,891 | 3/1985 | Mazis | 362/260 |
| 4,508,996 | 4/1985 | Clegg et al. | 315/219 |
| 4,667,133 | 5/1987 | Nilssen | 315/312 |

*Primary Examiner*—Eugene R. LaRoche

*Assistant Examiner*—Son Dinh

[57] ABSTRACT

A power-limited (Class-$\frac{2}{3}$) fluorescent lighting system suitable for use with suspended ceiling systems consists of the following principal components:

a) power-line-operated power supplies, each power supply having a plurality of outputs, with each such output being a 30 kHz voltage limited in voltage/current/power magnitudes in such a way as to constitute a Class-$\frac{2}{3}$ circuit in accordance with the National Electrical Code;

b) fluorescent lighting units, each such unit comprising one or more fluorescent lamps and a matching network operative to derive the requisite lamp operating voltages and currents from one of the Class-$\frac{2}{3}$ outputs of one of the power supplies; and c) for each lighting unit, a flexible wiring means to provide for easy plug-in connection with one of the individual outputs of said power supply.

The individual lighting units and its wiring means can safely and easily be installed and/or removed by persons of but ordinary skills.

The power provided to each lighting unit is provided at high power factor, thereby permitting a power level of nearly 100 Watt for each lighting unit. With the high frequency operation and with presently available high-efficacy fluorescent lamps, light output of up to 10,000 Lumens per lighting unit can be attained.

20 Claims, 2 Drawing Sheets

POWER-LIMITED CEILING LIGHTING SYSTEM

RELATED APPLICATIONS

This application is a continuation of application Ser. No. 06/703,027 filed Feb. 19, 1985, now abandoned; which was a continuation-in-part of application Ser. No. 06/450,187 filed Dec. 16, 1982, now abandoned.

BACKGROUND OF THE INVENTION

1. Field of the Invention

The present invention relates to a power-line-operated high-frequency power-limited lighting system, especially as applicable in a suspended ceiling system.

2. Description of Prior Art

A power-limited high-frequency lighting system is described in U.S. Pat. No. 4,293,799 to Roberts. However, that lighting system is specifically intended for safely operating relatively low-power low-output fluorescent lamps/luminaires in situations involving a hazardous atmosphere, such as in a coal mine, and is not suitable for general lighting applications for the following reasons.

i) The Roberts system provides for series-connection of a number of luminaires (typically five), all powered from a single power-limited output of a power supply. Thus, if one of these luminaires were to become disconnected, such as by removal or by breakage, all the other series-connected luminaires would lose power and become inoperable.

ii) The Roberts system is not suitable for operation with its power supply left unloaded in that the power supply would then dissipate an excessive amount of power, namely more than all the power that otherwise would be used by all the series-connected luminaires when operating at full power.

iii) The amount of light provided from each luminaire in the Roberts system—being only on the order of a few hundred Lumens—is entirely too low to be effective for general illumination.

iv) Roberts provides for an individual power-line-operated inverter for each power-limited output, i.e. for each set of series-connected luminaires, a practice that is non-conducive to achieving cost-effectivity in lighting systems for general lighting applications.

v) Due to the particular method of voltage-limiting used in the power supply of the Roberts system, each power-limited output can not be used to the full limit of the power level that otherwise would be safe to use.

Rationale Related to the Invention

Due to potential fire hazards, presently used power-line-operated ceiling lighting fixtures can not conveniently and safely be installed by persons of but ordinary skills. Moreover, the wiring means required for safe installation is relatively costly to acquire and cumbersome to install.

On the other hand, if lighting fixtures could be powered by way of so-called Class 2 or Class 3 electrical circuits (for definition of such circuits, see Section 725 of the National Electrical Code 1984), they could indeed be made such as to be conveniently and safely installed by persons of but ordinary skills.

However, the output of Class 2 or Class 3 circuits (hereinafter: Class-⅔ circuits) is strictly limited in maximum rated Volt-Amperes (100 VA) and would appear not to yield enough power to provide an amount of illumination that would be considered adequate in most ordinary lighting installations.

Yet, within its maximum Volt-Amp rating, a Class ⅔ circuit does have enough power potentially available to provide for an amount of illumination that is nearly equal to that normally obtained from one of the commonly used four-lamp fluorescent ceiling fixtures.

Hence, if means were provided by which such ceiling fixtures could each individually be powered by way of a Class ⅔ power source, a very safe and easy-to-install and simple-to-modify ceiling lighting system might result.

Against this background, it would seem useful to provide for a Power-Limited Ceiling Lighting System; which is indeed the overall object of the instant invention.

SUMMARY OF THE INVENTION

Objects of the Invention

One object of the present invention is that of providing for a high-efficiency lighting system that is safe and easy to install and suitable for general illumination.

Another object is that of providing for a fluorescent lighting system that is particularly well adapted to be used with suspended ceiling systems and that can readily and safely be installed, removed and/or reconfigured by persons of but ordinary skills.

These as well as other objects, features and advantages of the present invention will become apparent from the following description and claims.

Brief Description

Subject invention relates to a high-frequency power-limited (Class ⅔) fluorescent lighting system and consists of the following principal component parts:

a) a number of power-line-operated inverter-type power supplies, each such power supply providing for a plurality of separate outputs, each such separate output being of relatively high frequency (30 kHz and individually limited in terms of maximum available voltage, current and Volt-Ampere product in such a way as to conform to the requirements of a Class 2 or a Class 3 electrical circuit in accordance with the National Electrical Code.

b) a plurality of fluorescent lighting units, each such lighting unit comprising one or more fluorescent lamps and a matching network operative to derive the requisite lamp operating voltages and currents from one of the Class-⅔ power-limited outputs of one of said inverter-type power supplies; and c) a plurality of pairs of conductor wires adapted to provide for easy plug-in connection between each of the individual outputs of said power supplies and each individual fluorescent lighting unit—generally with one such lighting unit being connected with each of said outputs.

The power provided to each lighting unit is provided at a high power factor, thereby (under the Class ⅔ provisions of the National Electrical Code) permitting a power level of nearly 100 Watt to be provided to each lighting unit; which, with the indicated high frequency operation and with presently available high-efficacy fluorescent lamps, can provide for a light output of up to about 10,000 Lumens per lighting unit.

DESCRIPTION OF THE PREFERRED EMBODIMENT

Details of Construction

Figure 1:
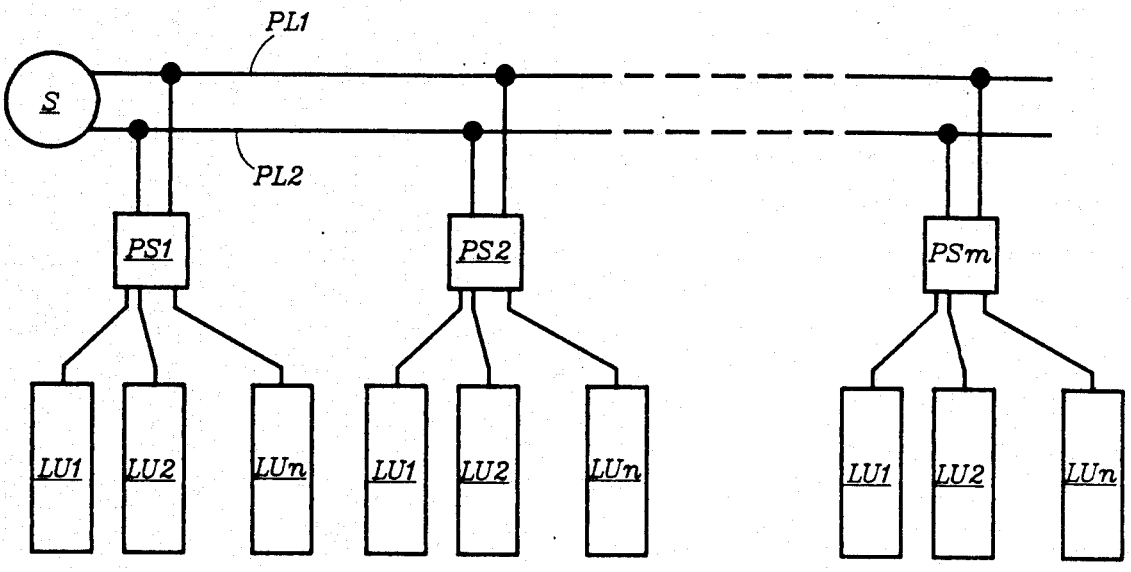
FIG. 1 schematically illustrates, from an overall systems viewpoint, the preferred embodiment of the invention; and shows a number of power-line-operated inverter-type power supplies, each providing a plurality of high-frequency power-limited (Class-$\frac{2}{3}$) AC voltage outputs, with each output operating a special fluorescent lighting unit.

In FIG. 1, a source S of 120 Volt/60 Hz voltage is applied to a pair of power line conductors PL1 and PL2. Connected at various points along this pair of power line conductors are a number m of power-line-operated inverter power supplies PS1, PS2–PSm. To each such power-line-operated power supply are connected a number n of fluorescent lighting units LU1, LU2–LUn. (The number n may be different for different power supplies and/or at different times.)

Figure 2:
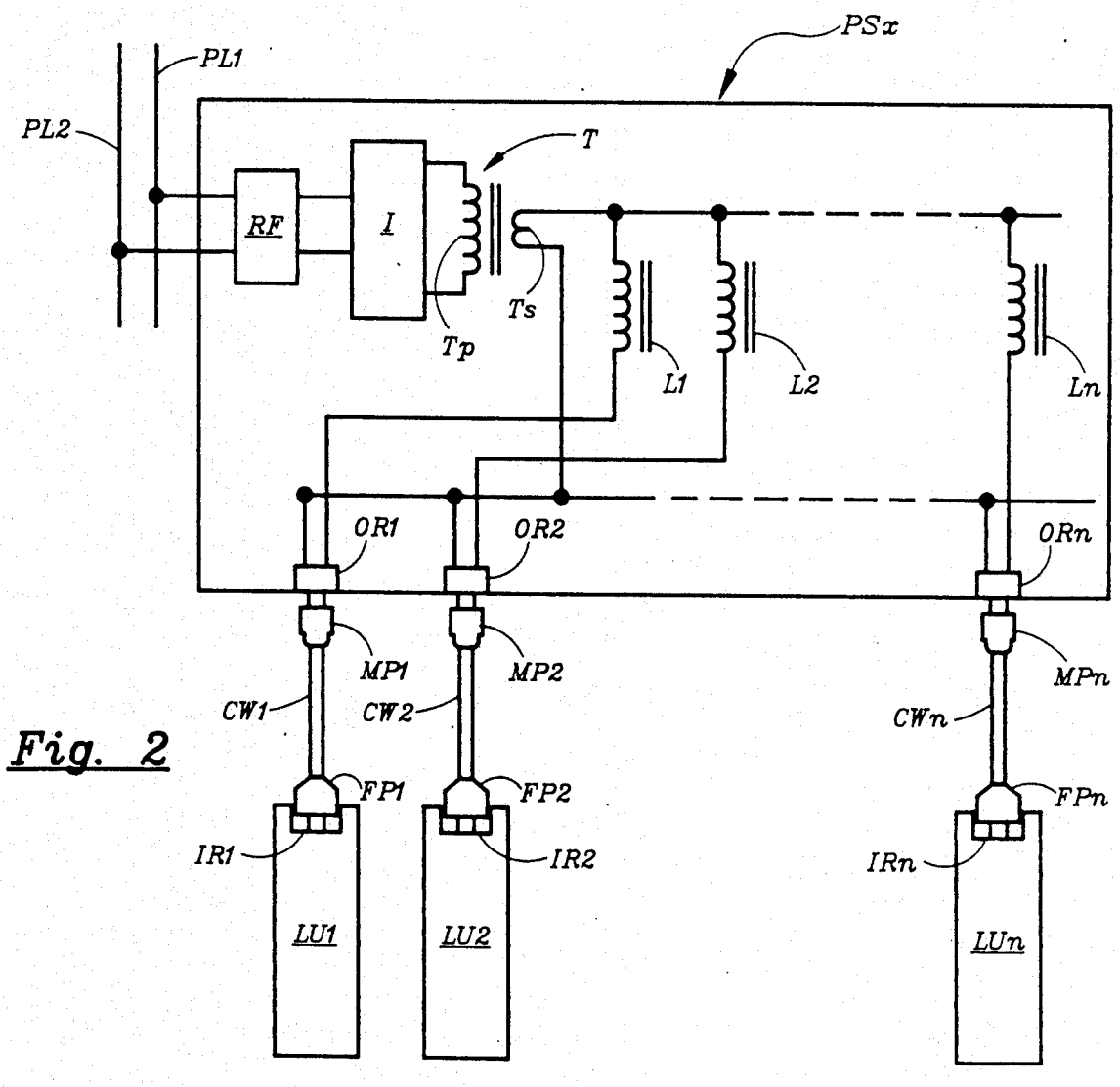
FIG. 2 schematically illustrates the preferred embodiment of one of said power supplies and its plurality of individually power-limited outputs and corresponding individual plug-in connections with a plurality of special fluorescent lighting units.

FIG. 2 illustrates in further detail one of the power supplies of FIG. 1 and its associated n lighting units.

This one power supply is referred to as PSx, and is powered from power line conductors PL1 and PL2. Inside PSx, power line conductors PL1 and PL2 are directly connected with a rectifier-filter combination RF, the substantially constant DC output voltage of which is applied to an inverter I.

The output from inverter I is a 30 kHz AC voltage, which AC voltage is applied to the primary winding Tp of an isolation transformer T. The output of transformer T is provided from its secondary winding Ts and is a 30 kHz AC voltage of approximately 30 Volt RMS magnitude. Secondary winding Ts is electrically isolated from primary winding Tp.

By way of a number n of inductor means L1, L2–Ln, this transformer output voltage is supplied to a number n of power output receptacles OR1, OR2–ORn, all respectively.

By way of male plugs MP1, MP2–MPn, conduction wire-pairs CW1, CW2–CWn, and female plugs FP1, FP2–FPn, the output receptacles OR1, OR2–ORn are connected with input receptacles IR1, IR2–IRn on fluorescent lighting units LU1, LU2–LUn, all respectively.

The assembly consisting of rectifier and filter means RF, inverter I, transformer T and the n output receptacles OR1, OR2–ORn, is referred to as power supply PSx.

Figure 3:
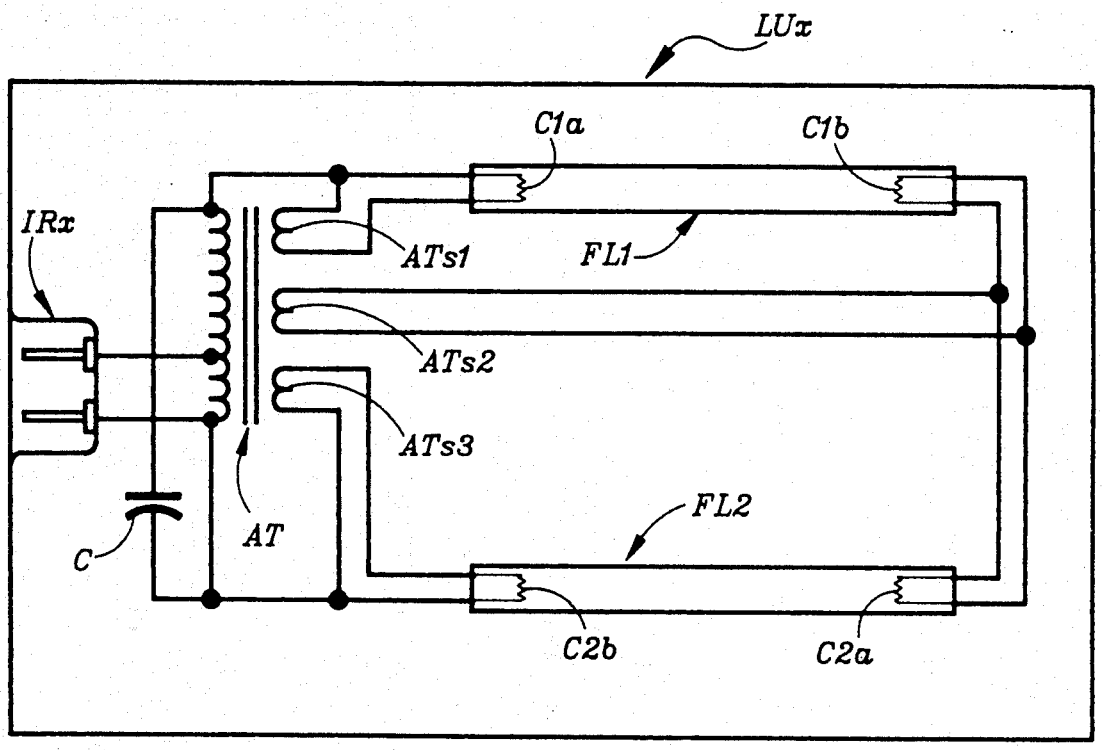
FIG. 3 schematically illustrates electrical circuit details of one of the special fluorescent lighting units.

FIG. 3 illustrates one of the n lighting units referred to in FIG. 2 as LU1, LU2–LUn. This one lighting unit is referred to as LUx and has a power input receptacle IRx.

Inside lighting unit LUx is a voltage-step-up auto-transformer AT, the input side of which is directly connected with input receptacle IRx and the output side of which is directly connected across a series-combination of two fluorescent lamps FL1 and FL2.

Fluorescent lamp FL1 has two cathodes C1*a* and C1*b*; and fluorescent lamp FL2 has two cathodes C2*a* and C2*b*.

Auto-transformer AT has three secondary windings ATs1, ATs2 and ATs3, all of which are electrically isolated from one another as well as from the input side of auto-transformer AT.

Secondary winding ATs1 is directly connected with cathode C1*a*; secondary winding ATs2 is directly connected with a parallel-connection of cathodes C1*b* and C2*a*; and secondary winding ATs3 is directly connected with cathode C2*b*.

A capacitor C is connected directly across the output side of auto-transformer AT.

Details of Operation

The operation of the system and circuits illustrated in FIGS. 1 to 3 may be explained as follows.

In FIG. 1, the pair of power line conductors PL1 and PL2 provides 120 Volt/60 Hz power to each and every inverter power supply: PS1, PS2–PSm.

Each and every inverter power supply converts its 120 Volt/60 Hz input voltage to a plurality of power-line-isolated power-limited high-frequency low-magnitude AC voltage outputs; and each such AC voltage output is directly connected with a fluorescent lighting unit—powering this fluorescent lighting unit by way of said power-limited high-frequency low-magnitude AC voltage.

FIG. 2 shows how said power-line-isolated power-limited high-frequency low-magnitude AC voltage outputs are obtained.

The 120 Volt/60 Hz power line voltage is applied to a rectifier-filter combination of conventional construction; and the output from this rectifier-filter combination is a substantially constant DC voltage. This DC voltage is inverted by conventional inverter I to a 30 kHz AC voltage of essentially squarewave shape.

This 30 kHz squarewave inverter output voltage is applied to the primary winding of voltage-step-down high-frequency transformer T; which transformer is of conventional construction.

This transformer also provides for electrical isolation between its primary and secondary windings, thereby providing for power-line-isolation of the AC voltage outputs from power supply PSx.

The output of the secondary winding Ts of transformer T is a 30 kHz non-power-limited essentially squarewave-shaped AC voltage with a substantially constant RMS magnitude of about 30 Volt; which AC voltage is provided to the n power output receptacle OR1, OR2–ORn of power supply PSx by way of n inductors L1, L2–Ln.

Thus, the magnitude of the current available at any one of these power output receptacles is limited by the reactance of the inductor connected in series circuit with that receptacle. The magnitude of the reactance of this inductor is chosen such that the current resulting when a given output receptacle is short-circuited is no higher than 8 Amp RMS.

The high-frequency AC voltage output from each of the n power output receptacles is applied to a fluorescent lighting unit by way of a conduction wire-pair and its associated male/female plug means.

FIG. 3 shows how the individual lighting units work and more particularly, how the ballasting of the fluorescent lamps is accomplished.

The output from one of the output receptacles of power supply PSx is applied by way of a conduction wire-pair to power input receptacle IRx of lighting unit LUx, from where it is applied directly to a voltage step-up transformer AT, the output of which is applied directly across two series-connected fluorescent lamps.

The actual ballasting of the two fluorescent lamps is accomplished by way of resonant interaction between the capacitor (which is connected in parallel across the two series-connected fluorescent lamps) and the particular inductor located in the power supply feeding power to the lighting unit LUx.

In other words, part of the ballasting function for the two fluorescent lamps of lighting unit LUx is accomplished by way of one of the inductors within the power supply PSx.

The rest of the circuit functions within LUx, such as the provision of cathode heating by way of the three secondary windings on AT, is accomplished in manners well understood by those skilled in the art.

Comments a) Any one of the lighting units, such as lighting unit LUx, may comprise any number of fluorescent lamps. However, within the context of the present embodiment, it is important that all the fluorescent lamps powered from a single output from any of the inverter power supplies be ballasted as a single entity and that the aggregate Volt-Ampere product drawn from this output not exceed 100 VA.

b) Due to the resonant matching of the fluorescent lamp loads to the source of high-frequency power, the current drawn from the inverter power supplies by the different lighting units will be nearly sinusoidal in waveshape, a fact that is important in respect to minimizing possible radio-frequency interference.

c) Also due to this resonant matching, the current drawn from each of the individual power-limited outputs of the inverter power supplies is substantially in phase with the fundamental component of the square-wave AC voltage outputs provided by these power supplies. Hence, the power drawn by the lighting units is drawn with a high power factor, which implies a maximization of the power available within a set limit of Volt-Amperes.

d) Capacitor C, which is shown in FIG. 3 as being connected across the secondary side of transformer AT, may just as well be connected across the primary side of said transformer. In fact, to provide for the desired power factor correction, the capacitor may even be connected in series with the output or input side of said transformer.

e) It is noted that the lighting units may comprise incandescent lamps.

f) Finally, it is noted that the lighting fixtures of subject lighting system can safely and easily be installed and/or removed by persons of but ordinary skills, without requiring the assistance of an electrician, for the following reasons.

i) As shown in FIG. 2, each lighting unit (or luminaire) is disconnectably connected with its power source by way of a conduction wire-pair and its associated male/female plug means—as contrasted with the usual way of connecting lighting fixtures, which entails the mounting of conduits or armored cable as well as screw-connections or solder-connections of bare wires (as in so-called bare-wire connections).

In the lighting system of the present invention, no conduits or armored cable is required because the system can be classified as a so-called power-limited (i.e., Class-2 or Class-3) circuit under the National Electrical Code; which implies that said conduction wire-pair may be a light-weight non-conduited non-armored flexible cable.

Thus, a luminaire under subject lighting system can be connected to and/or disconnected from its power source simply by way of plugging-in or un-plugging a relatively light-weight power cord with a set of plug-and-receptacle means—without having to handle any conduit or armored cable and without having to make any bare-wire connections.

In other words, the luminaires may be plugged-in and/or unplugged in the same way as an ordinary table lamp may be plugged-into and/or unplugged-from a common household electrical receptacle.

ii) Due to the relatively high frequency of operation (on the order of 30 kHz), the size and weight of the ballasting means within each of the luminaires of subject lighting system is substantially smaller-in-size and lighter-of-weight as compared with its conventional magnetic (non-electronic) ballast counterpart. As a result of this, combined with the fact that the luminaire no longer needs to have the capability to contain a non-limited source of power (i.e., the luminaire need not be capacle of containing a fire: it need not be flame-proof), the luminaire can be made to weigh substantially less than a presently conventional lighting fixture (i.e., the luminaire's body or enclosure can safely be made with lighter-weight and/or less fire-proof material), and will therefore be easier to handle.

g) The word "fixture" normally refers to a fixturable or fixtured (i.e., permanently installed) item. To provide for a term without such connotation, and which therefore fits better as a descriptor for the term "lighting unit" as used herein, the word "luminaire" is herewith defined as a lighting unit that may or may not be fixtured.

h) The term "central power supply" refers to a single power supply feeding a plurality of separately and individually power-limited outputs. The modifier "central" refers to the notion that this power supply normally would be placed in a central location relative to the positions of the various luminaires to which it provides power. To minimize problems with radio-frequency radiation and skin-effect associated with the power cords feeding each individual luminaire from the central power supply, the distance from the central power supply to the most distant luminaire powered from that power supply should not exceed 20 feet.

i) The term "suspended ceiling" refers to a ceiling system consisting of a grid (ceiling grid) suspended some distance below a permanent ceiling and having removable panels (ceiling panels) for placement into openings in the grid (grid openings). In most anticipated usage situations, the lighting units or luminaires described by the present invention are intended to be removably placed in the grid openings of a suspended ceiling grid—just like an ordinary ceiling panel. The central power supplies are expected to be permanently fastened to the permanent ceiling above the ceiling grid—with each individual such power supply being located in such a way as to be approximately central in location in respect to the plurality of luminaires that are to be powered from it.

j) The term "partial load" refers to situations where a central power supply is connected with fewer luminaires than it has the capability of powering. A central power supply is operating on partial load if it has, say, eight individual power-limited outputs but having luminaires connected to, say, only six of these.

It is believed that the present invention and its several attendant advantages and features will be understood from the preceeding description. However, without departing from the spirit of the invention, changes may be made in its form and in the construction and interrelationships of its component parts, the form herein presented merely representing a presently preferred embodiment.

I claim:

1. A power conditioner for use in a lighting system and operable to power a plurality of luminaires used for providing general illumination in spaces used for human occupancy, said power conditioner being operable to connect with an ordinary electric utility power line, said power line being capable of providing a maximum available Volt-Ampere output so large as to be considered unsafe from a fire-initiation viewpoint, a maximum available Volt-Ampere output higher than about 100 Volt-Ampere normally being considered unsafe from a fire initiation viewpoint, said power conditioner comprising:

a plurality of pairs of power output terminals, each one of these pairs of power output terminals being: i) operable to connect with and to power one of said luminaires, and ii) limited separately and individually to provide electrical output that may be as high as, but is limited to be not higher than, the maximum Volt-Ampere output that under normally encountered circumstances may be considered safe from a fire-initiation viewpoint, such that, substantially regardless of the load presented to any given pair of power output terminals, the maximum Volt-Ampere output available form this given pair of power output terminals is limited by means internal of the power conditioner to be no higher than the maximum available Volt-Ampere output considered safe from a fire initiation viewpoint.

2. The power conditioner of claim 1 wherein said maximum available Volt-Ampere output is limited by means internal of the power conditioner to an amount that is considered safe from fire initiation hazard in accordance with generally accepted guidelines, such as or similar to those specified for Class 2 and Class 3 circuits in ARTICLE 725 of the NATIONAL ELECTRICAL CODE published by NATIONAL FIRE PROTECTION ASSOCIATION, Quincy, Mass., United States of America.

3. The power conditioner of claim 1 comprising frequency conversion means operative to cause the frequency of the voltage provided at one or more of said pairs of power output terminals to be substantially higher than that of the voltage on said electric utility power line.

4. The power conditioner of claim 1 comprising frequency conversion means operative to cause the voltage provided at two or more of said pairs of power output terminals to be alternating in synchrony at a frequency that is substantially higher than that of the voltage on said power line.

5. The power conditioner of claim 1 wherein at least one of said pairs of power output terminals has receptacle means operative to receive plug means, thereby permitting a luminaire to be removably connected with one of said power outputs by way of plug and receptacle means.

6. A power conditioner connectable with an ordinary electric utility power line, said power line being capable of providing a maximum available Volt-Ampere output so large as to be considered unsafe from a fire-initia.ion viewpoint, a maximum available Volt-Ampere output higher than about 100 Volt-Ampere normally being considered unsafe from a fire-initiation viewpoint, said power conditioner comprising:

frequency converter means connected with said power line and operable to provide at each of plurality of individual power outputs an AC voltage of frequency substantially higher than that of the voltage on said power line;

connect. means associated with at least one of said power outputs and operable to connect a load thereto; and limiting means associated with each one of said individual power outputs and operable to limit the maximum Volt-Ampere output available therefrom to be as high as, but not higher than, the maximum Volt-Ampere product that may be considered safe from a fire-initiation viewpoint.

7. The power conditioner of claim 6 wherein said connect means comprises receptacle means operable to receive a plug means, thereby providing for disconnectable plug-in connection of said load.

8. A power conditioner for use in a lighting system and operable to power a number of luminaires suitable to provide general illumination in buildings used for human occupancy, said power line being capable of providing a maximum available Volt-Ampere output so large as to be considered unsafe from a fire-initiation viewpoint, said power conditioner comprising: P1 means for connecting with and to be powered from an ordinary electric utility power line; and a plurality of individually Volt-Ampere-limited power outputs, each such power output having: (i) an AC voltage of frequency substantially higher than that of the voltage on said power line, (ii) connect means operable to connect with and to power one of said luminaires, and (iii) current-limiting means operative to permit the flow therefrom of any magnitude of current up to a level that may be as high as, but not higher than, the level that results in the maximum Volt-Ampere product that under normally encountered circumstances in such a building may be considered safe from a fire-initiation viewpoint.

9. The power conditioner of claim 8 wherein the AC voltage at two or more of said power outputs is of the same frequency and synchronous.

10. The power conditioner of claim 8 wherein said current-limiting means functions to provide current-limiting without the use of dissipative elements.

11. A luminaire operable to provide illumination in a building used for human occupancy and adapted to be powered from a power-limited source located remotely from the luminaire and characterized by having: (i) output characteristics, and (ii) means operative to limit its Volt-Ampere output to be no higher than the maximum Volt-Ampere product that is considered safe from a fire-initiation viewpoint, said luminaire comprising:

a lamp characterized by having input characteristics;

plug/cord/receptacle means operable to provide disconnectable plug-in connection with said source;

matching means connected in circuit between said plug means and said lamp, and operative to match the lamp's input characteristics with the source's output characteristics; and enclosure operative to provide supportive structure for said lamp.

12. The luminaire of claim 11 wherein said enclosure is of a construction that would be considered unsafe from a fire-initiation viewpoint, except when powered from said power-limited source.

13. The luminaire of claim 11 and means to prevent it from operating when powered from a non-current-limited source of voltage.

14. The luminaire of claim 11 wherein said maximum Volt-Ampere product is limited to an amount that is considered safe from fire-initiation hazard in accordance with generally accepted guidelines, such as or similar to those specified for Class-2 and Class-3 electrical circuits in ARTICLE 725 of the NATIONAL ELECTRICAL CODE.

15. An arrangement comprising:

a source providing a first AC voltage at a pair of distribution conductors; a first maximum amount of Volt-Ampere output being extractable from the distribution conductors; this first maximum amount of Volt-Ampere output being so high as not to be considered safe from fire-initiation hazard;

power conditioner means connected with the distribution conductors at some location remote from the source and operative to provide a second AC voltage at each one of plural power-limited outputs; at least one of the power-limited outputs having receptacle means with a pair of output terminals; a second maximum amount of Volt-Ampere output being extractable from said each one of the plural power-limited outputs; this second maximum amount of Volt-Ampere output being so low as to be considered safe from fire-initiation hazard, such that, substantially regardless of the load presented to the pair of power output terminals, the maximum Volt-Ampere output available from this pair of power output terminals is limited by means internal of the power conditioner means to be no higher than the maximum available Volt-Ampere output considered safe from fire initiation hazard; and plural load means; at least one of the plural load means having an electrical connect cable with plug means operable to be plugged into said receptacle means.

16. The arrangement of claim 15 wherein the power conditioner means includes plural frequency conversion means.

17. The arrangement of claim 15 wherein the second AC voltage is substantially different from the first AC voltage in at least one major parameter, such as frequency.

18. The arrangement of claim 15 wherein the parameters of the second AC voltage are such as to make this second AC voltage substantially safe from electric shock hazard to a person coming in direct contact therewith.

19. An arrangement comprising:

a source providing a power line voltage to a pair of distribution conductors; the distribution conductors, when indeed connected with the source, being capable of providing a maximum available Volt-Ampere output so large as to be considered unsafe from a fire-initiation viewpoint; a maximum available Volt-Ampere output higher than about 100 Volt-Ampere normally being considered unsafe from a fire-initiation viewpoint;

a first plurality of luminaires operable to provide general illumination in spaces used for human occupancy; at least one of these luminaires having a pair of power input terminals; and a second plurality of power conditioner means connected with the distribution conductors at spaced-apart locations therealong; at least one of the plural power conditioner means having at least one pair of power output terminals operable: (i) to connect, by way of disconnectable plug and receptacle means, with said power input terminals; and (ii) to provide an electrical output that may be as high as, but is limited to be no higher than, the maximum Volt-Ampere output that under normally encountered circumstances may be considered safe from a fire-initiation viewpoint; such that, substantially regardless of the load presented to said pair of power output terminals, the maximum Volt-Ampere output available therefrom is limited by means internal of said at least one of the power conditioner means to be no higher than the maximum Volt-Ampere output considered safe from a fire-initiation viewpoint.

20. The arrangement of claim 19 wherein said electric output is an AC voltage of frequency substantially higher than that of the power line voltage.

* * * * *